US010463204B2

(12) United States Patent
Barredo

(10) Patent No.: US 10,463,204 B2
(45) Date of Patent: Nov. 5, 2019

(54) CORELESS ROLL AND A MANUFACTURING METHOD

(71) Applicant: SCA TISSUE FRANCE, Saint-Ouen (FR)

(72) Inventor: Donald Barredo, Ingersheim (FR)

(73) Assignee: ESSITY OPERATIONS FRANCE, Saint-Ouen (FR)

( * ) Notice: Subject to any disclaimer, the term of this patent is extended or adjusted under 35 U.S.C. 154(b) by 123 days.

(21) Appl. No.: 15/549,245

(22) PCT Filed: Feb. 16, 2015

(86) PCT No.: PCT/IB2015/000576
§ 371 (c)(1),
(2) Date: Aug. 7, 2017

(87) PCT Pub. No.: WO2016/132168
PCT Pub. Date: Aug. 25, 2016

(65) Prior Publication Data

US 2018/0014699 A1 Jan. 18, 2018

(51) Int. Cl.
*A47K 10/16* (2006.01)
*B65H 19/22* (2006.01)
(Continued)

(52) U.S. Cl.
CPC ..... *A47K 10/16* (2013.01); *B65H 18/28* (2013.01); *B65H 19/2276* (2013.01);
(Continued)

(58) Field of Classification Search
CPC ..... A47K 10/16
(Continued)

(56) References Cited

U.S. PATENT DOCUMENTS 5,344,091 A 9/1994 Molison
5,904,329 A 5/1999 Kanome et al.
(Continued)

FOREIGN PATENT DOCUMENTS

CN 1132716 A 10/1996
EP 0639520 A1 2/1995
(Continued)

OTHER PUBLICATIONS

Russian Decision to Grant dated Aug. 6, 2018 issued in Russian patent application No. 2017132171 (9 pages) and its English-language translation thereof (7 pages).
(Continued)

*Primary Examiner* — Brent T O'Hern
(74) *Attorney, Agent, or Firm* — Drinker Biddle & Reath LLP

(57) ABSTRACT

A coreless roll of absorbent sheet products is made of a spirally wound web of absorbent substrate including at least two superposed plies of absorbent substrate, the web of absorbent substrate being wound such as to define an axial hollow passageway centrally positioned relatively to the coreless roll and extending from one edge to another edge of the coreless roll. The web of absorbent substrate further includes a stiffening insert, the stiffening insert being inserted in-between two superposed plies of absorbent substrate, the stiffening insert being positioned such as to line the axial hollow passageway, the stiffening insert having a length such that the stiffening insert extends at least around three quarter of a circumference of the passageway, preferably substantially completely around a circumference of the passageway.

10 Claims, 4 Drawing Sheets

(51) Int. Cl.
*B65H 18/28* (2006.01)
*B65H 19/26* (2006.01)

(52) U.S. Cl.
CPC . *B65H 19/26* (2013.01); *B65H 2301/414325* (2013.01); *B65H 2301/418925* (2013.01); *B65H 2701/18422* (2013.01); *B65H 2701/1924* (2013.01); *B65H 2701/5112* (2013.01)

(58) Field of Classification Search
USPC ..... 428/98
See application file for complete search history.

(56) References Cited

U.S. PATENT DOCUMENTS

| | | | | |
|---|---|---|---|---|
| 2008/0245923 | A1 | 10/2008 | Maddaleni et al. | |
| 2009/0101748 | A1 | 4/2009 | Maddaleni et al. | |
| 2010/0320302 | A1 | 12/2010 | Pappas et al. | |
| 2016/0137398 | A1* | 5/2016 | Lemke ..... | B65D 85/671 206/386 |

FOREIGN PATENT DOCUMENTS

| | | | |
|---|---|---|---|
| EP | 1256541 | A2 | 11/2002 |
| EP | 1380526 | A2 | 1/2004 |
| EP | 2266904 | A2 | 12/2010 |
| EP | 2266904 | A3 | 9/2011 |
| GB | 1554619 | A | 10/1979 |
| RU | 2408522 | C2 | 1/2011 |

OTHER PUBLICATIONS

Chilean First Examination Report dated Jan. 31, 2019 issued in Chilean patent application No. 201702048 (10 pages) and its partial English-language translation thereof (2 pages).
First Chinese Office Action dated Sep. 28, 2018 issued in Chinese patent application No. 201580076306.8 (5 pages) and its English-language translation thereof (6 pages).

* cited by examiner

CORELESS ROLL AND A MANUFACTURING METHOD

CROSS-REFERENCE TO PRIOR APPLICATION

This application is a § 371 National Stage Application of PCT International Application No. PCT/IB2015/000576 filed Feb. 16, 2015, which is incorporated herein in its entirety.

TECHNICAL FIELD

The disclosure relates to a coreless roll of absorbent sheet products. The disclosure also relates to a manufacturing method for manufacturing such a coreless roll. Such absorbent sheet products may have a particular, though non-exclusive, use as sanitary or domestic purposes. As an example, such absorbent sheet products may be used as toilet paper in restrooms. Others uses as napkins, towels, bath tissues, etc. . . . are possible.

BACKGROUND

The web of absorbent substrate may be a web of tissue paper that is obtained by a Conventional Wet Press or Through Air Drying manufacturing method or other manufacturing method. A tissue paper relates to an absorbent paper based on cellulose fibers which is also called tissue paper base sheet in this field of technology. A typical absorbent paper has a low basis weight, in the range from 10 to 60 g/m$^2$, or from 30 to 50 g/m$^2$.

The web of absorbent substrate may also be a web of nonwoven fabric that is obtained by an air-laid manufacturing method or spun-laid manufacturing method or other manufacturing method. A nonwoven fabric including cellulosic fibers relates to an absorbent paper which is also called nonwoven or web made of fibers like air-laid web in this field of technology. A typical absorbent paper has a basis weight, in the range from 20 to 300 g/m$^2$, or from 40 to 60 g/m$^2$.

Rolls of absorbent sheet products for consumers are thick and soft products. Such products show a low resistance to compression (perpendicularly to the axis of the roll/core). This is particularly the case for coreless rolls.

The document GB1554619 describes the manufacturing of a coreless roll. The method includes spraying a water based liquid on a number of turns just before the web material is wound. This enables producing a stable and rigid core with the first turn of web material that is more resistant to collapsing.

However, in the frame of industrial manufacturing, the web material is run at a speed of around 10 m/s (reference in the tissue paper industry is around 600 m/min). Logs of web material are produced and then cut into individual rolls. Further, a consumer toilet paper log/roll has a web length of around 12 m. Furthermore, applying a water based liquid onto such a web material negatively affects the intrinsic quality of the product. This means that only a few numbers of turns should be concerned by the spraying. As a consequence, for treating a few numbers of turns, the water based liquid must be sprayed during less than 1/10th of second. This is technically complex and costly to implement in the frame of industrial manufacturing.

The document U.S. Pat. No. 5,344,091 describes an apparatus and method for winding stiffened coreless roll which include a spiral wound roll formed from this product paper, conventionally paper having a printed pattern or design on one side (i.e. wrapping paper of the type used to wrap birthday and holiday gifts and other package), and a spiral stiffener sheet extending completely around the roll to stiffen the roll. The apparatus receives continuous webs of product paper and stiffening paper, severs the stiffening paper into short lengths for winding into the roll of product paper and automatically feeds the stiffening sheet onto a length of product paper which is wound into a roll. The two webs are fed to either side of a continuous rotating cutter roll. Anvil assemblies are moved into engagement with a knife carried on the cutter roll for selectively severing the webs as required.

However, at the end of the roll, namely when the user attains the last sheet portion of the roll, the last portion with the stiffener paper, or at least the stiffener paper taken separately cannot be used and must be discarded.

Thus, there is a need to improve coreless rolls. In particular, it should be desirable to be able to use coreless rolls of absorbent sheet products that are resistant to collapsing until the last sheet.

SUMMARY

It is desired to provide a coreless roll that overcomes the drawbacks of the prior art coreless roll. In particular, it is desirable to avoid, or at least to reduce, the collapsing of the coreless roll while the coreless roll is manufactured, packaged, shipped, commercialized and used in a suitable manner by the end consumer. More particularly, embodiments of the invention seek to solve the collapsing issue at the manufacturing step even for web of absorbent substrate running at an industrial manufacturing speed in a converting machine (e.g. up to 1.000 m/min).

According to one aspect, there is provided a coreless roll of absorbent sheet products made of a spirally wound web of absorbent substrate including at least two superposed plies of absorbent substrate, the web of absorbent substrate being wound such as to define an axial hollow passageway centrally positioned relatively to the coreless roll and extending from one edge to another edge of the coreless roll, wherein the web of absorbent substrate further includes a stiffening insert, the stiffening insert being inserted in-between two superposed plies of absorbent substrate, the stiffening insert being positioned such as to line the axial hollow passageway, the stiffening insert having a length such that the stiffening insert extends at least around three quarter of a circumference of the passageway.

The stiffening insert may have a length such that the stiffening insert extends substantially completely around a circumference of the passageway.

The stiffening insert position and length may be arranged such that a leading end and a trailing end according to a length direction of the stiffening insert overlap each other.

The stiffening insert position and length may be arranged such that the leading and trailing ends according to the length direction of the stiffening insert overlap each other over a defined number of turns so as to form a spirally conformed stiffening portion.

The stiffening insert may have a stiffness such that a resistance to compression of the coreless roll is at least half a resistance to compression of a roll including a cardboard core.

The stiffening insert may have a basis weight ranging between 20 and 140 g/m$^2$, or between 40 and 120 g/m$^2$.

The stiffening insert may have a width that is equal to a width of the web of absorbent substrate.

The stiffening insert may include at least two stripes distributed along the width of the web of absorbent substrate so as to form rings at edges of the coreless roll, a total width of the stripes being inferior to the width of the web of absorbent substrate.

The stiffening insert may be bonded to at least one of the two superposed plies of absorbent substrate.

The stiffening insert may be made from tissue paper material, non woven material, tissue paper material treated with a binding agent, non woven material treated with a binding agent, cardboard, kraft paper, or synthetic polymer.

According to another aspect, there is provided a use of the coreless roll as absorbent sheet products chosen from napkins, towels, kitchen towels, hand towels, toilet papers, wipes or facial tissues.

According to a further aspect, there is provided a manufacturing method for manufacturing coreless rolls of absorbent sheet products including:

- conveying at least a first ply of absorbent substrate and a second ply of absorbent substrate according to a machine direction,
- inserting a stiffening insert in-between said first and second plies of absorbent substrate,
- associating the first and second plies of absorbent substrate into a web of absorbent substrate,
- spirally winding the web of absorbent substrate so as to produce a log of web of absorbent substrate, the web of absorbent substrate being wound such as to define an axial hollow passageway centrally positioned relatively to the log and extending from one edge to another edge of the log,
- severing the web of absorbent substrate substantially transversally relatively to the machine direction, and
- cutting the log into multiple coreless rolls, wherein the stiffening insert is positioned such as to line the axial hollow passageway, the stiffening insert having a length such that the stiffening insert extends substantially completely around a circumference of the passageway.

The manufacturing method may further include adjusting a position of the stiffening insert relatively to a severing line between two consecutive logs such that a leading end of the stiffening insert according to a length direction and a trailing end of the stiffening insert forms a lining portion of the axial hollow passageway of the log.

The manufacturing method may further include adjusting a position of the stiffening insert relatively to a severing line between two consecutive logs such that a leading end of the stiffening insert according to a length direction forms a gripping portion of a first log N and a trailing end of the stiffening insert forms a lining portion of the axial hollow passageway of a subsequent second log $N_{+1}$.

A temporary core may be inserted before the winding step so as to support a well defined axial hollow passageway.

The temporary core may be extracted before the log is cut into multiple coreless rolls.

With embodiments of the invention, it is possible to avoid, at least greatly reduce, the risk of collapsing of coreless rolls from the manufacturing stage to the using stage. This is particularly efficient during the handling and transporting steps when coreless rolls may be flattened as a result of various constraints exerted perpendicularly to the longitudinal axis of the coreless rolls. Embodiments of the invention enable maintaining the shape of the axial hollow passageway as a tubular cavity.

Other advantages will become apparent from the hereinafter description of embodiments of the invention.

BRIEF DESCRIPTION OF THE DRAWINGS

Embodiments of the present invention are illustrated by way of examples and not limited to the accompanying drawings, in which like references indicate similar elements.

DETAILED DESCRIPTION OF PARTICULAR EMBODIMENTS

Figure 1:
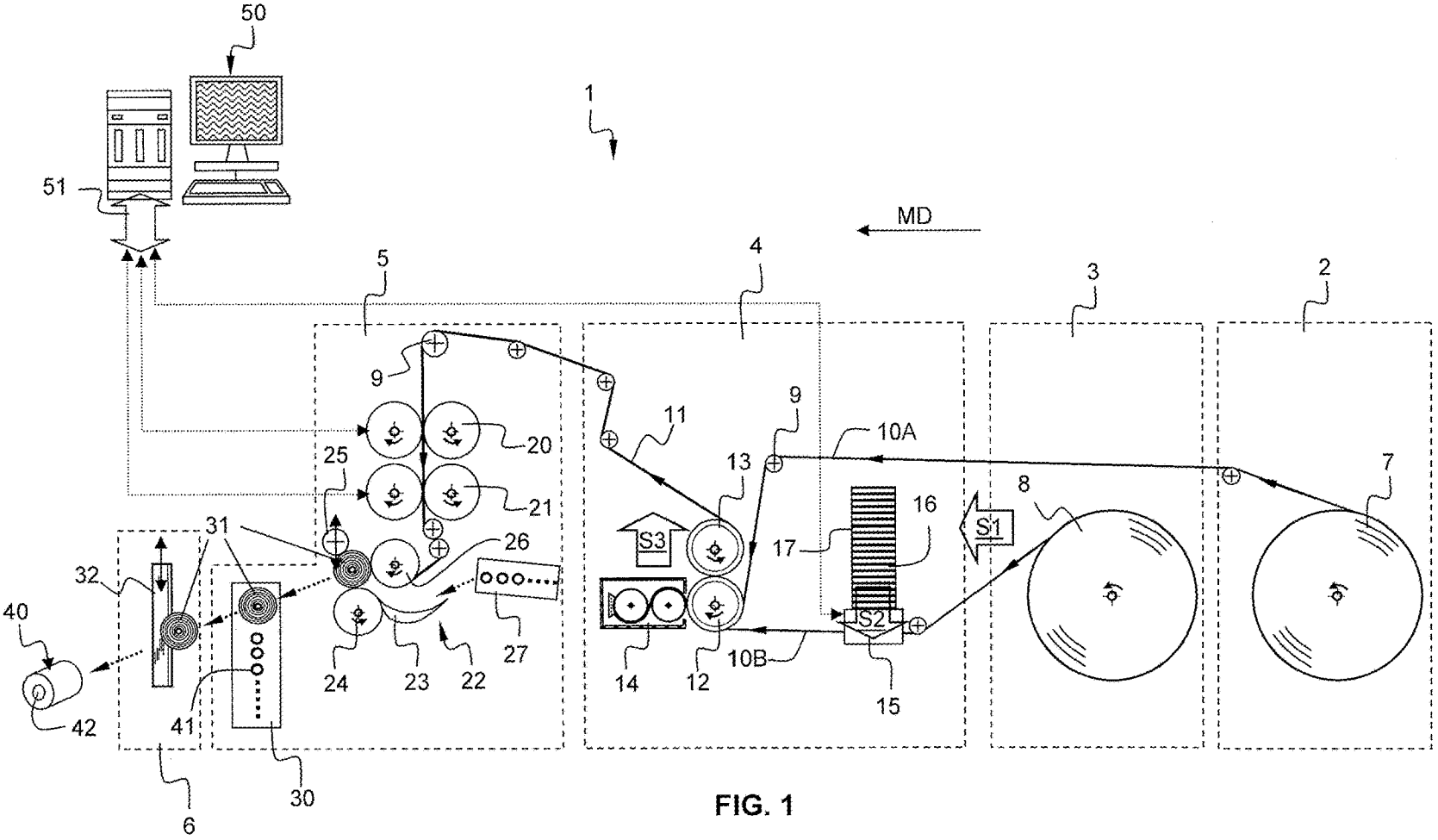
FIG. 1 is a partial side cross-section view schematically showing a converting machine/line illustrating the manufacturing of coreless rolls according to an embodiment of the invention.

FIG. 1 is a partial side cross-section view schematically illustrating a converting machine/line 1 arranged to manufacture coreless rolls 40. In this example, the converting machine/line 1 includes two unwinding units 2 and 3, an embossing unit 4, a rewinding unit 5, and a log cutting unit 6.

More precisely, at the stage of FIG. 1, absorbent log base webs 10A, 10B have already been produced according to a known papermaking process. FIG. 1 illustrates a later stage which is a stage where a converting process takes place. The converting process converts large parent log base webs 10A, 10B (e.g. having a strip width from around 1.80 m to around 7 m) into retail sized rolls 40, e.g. bathroom tissue rolls, paper towels rolls (e.g. having a strip width from around 8 cm to around 40 cm). In this particular example, the converting machine/line 1 produces retail sized coreless rolls having two plies.

A first unwinding unit 2 provides a first absorbent log base web 10A from a first parent roll 7. A second unwinding unit 3 provides a second absorbent log base web 10B from a second parent roll 8. Both absorbent log base webs 10A, 10B are fed to the embossing unit 4 (step S1).

Various rollers 9 are appropriately positioned in order to control the path of the absorbent log base webs 10A, 10B along the converting machine/line 1, within and between the various units 2, 3, 4, 5, 6. The absorbent log base webs 10A, 10B travels into the converting machine/line 1 according to the machine direction MD from the unwinding units 2 and 3, towards the embossing unit 4, towards the rewinding unit 5 and towards the log cutting unit 6.

The embossing unit 4 includes an engraved cylinder 12, a mating rubber cylinder 13, both rotating in opposite directions, a glue dispenser 14 and an insertion unit 15. In the present exemplary embodiment, the insertion unit 15 prepares and positions a stiffening insert 16 onto an interior face of the absorbent log base web 10B (step S21). The insertion unit 15 includes a stockpile 17 of individual stiffening inserts 16 already having defined size (width and length) adapted to line the axial hollow passageway 42 of the produced logs/rolls. The insertion unit 15 may alternatively include means to cut the stiffening insert 16 of defined size from a parent roll (not shown). The interior face means that each stiffening insert 16 is positioned onto the web such that after the embossing unit, it is inserted in-between the first and second absorbent log base webs 10A, 10B. The absorbent log base webs 10A, 10B are superposed and combined (associated) into the embossing unit 4 in order to form a web of absorbent substrate 11 (step S3). The engraved cylinder 12 may be engraved with a microstructure pattern combining various embossing tips (not shown). The engraved cylinder 12 may perform a simple or a double-level engraving into the superposed absorbent log base webs 10A, 10B. The glue dispenser 14 typically includes a vat, an applicator cylinder and a dipping cylinder. The applicator cylinder abuts the superposed absorbent log base webs 10A, 10B against the engraved cylinder 12. The dipping cylinder picks up the adhesive in the vat and transfers the adhesive to the applicator cylinder. The applicator cylinder is arranged to exercise a determined pressure on the engraved cylinder at the distal area of protuberances of the embossed absorbent log base webs 10A, 10B. At said determined pressure, the adhesive crosses through both absorbent log base webs 10A, 10B. This is used to combine both webs and, also, to emboss or micro-emboss at least one of the absorbent log base webs 10A, 10B in order to generate esthetical effects or modify the thickness, or the softness, or the suppleness of the resulting web of absorbent substrate 11. The stiffening insert 16 is also associated to the absorbent log base webs 10A, 10B as a result of their travel between the cylinders. Such steps are known in the art, not germane to the current invention, and, therefore, will not be described in details.

The stiffening insert 16 is independently prepared and internally positioned between the two webs forming the future plies of the coreless roll of absorbent sheet products. The stiffening insert 16 is made of a material that may be treated or non-treated tissue paper/non woven material, or cardboard, or kraft paper, or synthetic polymer. The material may have a basis weight ranging from 20 g/m$^2$ to 140 g/m$^2$, or from 40 g/m$^2$ to 120 g/m$^2$. The choice of the material depends on the resistance to compression to be achieved. The material may be treated with a binding agent, for example a polymer like polyethylene glycol (PEG), starch or carboxymethyl cellulose (CMC). The material of the stiffening insert may be chosen such as to confer to the coreless roll a resistance to compression related to standard roll including cardboard core, for example a stiffening insert may have a stiffness such that a resistance to compression of the coreless roll is at least half a resistance to compression of a roll including a cardboard core (the measurement protocol of resistance to compression is disclosed in a paragraph following Table in the description). Further, the stiffening insert may have a defined flexibility such as to resume a shape of the axial hollow passageway to a substantially cylindrical shape after the coreless roll has been submitted to a compression transversally relatively to the axial hollow passageway during manufacture, packaging or transport, and is reshaped for use. The quality and properties (in term of softness, absorbency, etc. . . . ) of the superficial surface of the absorbent sheet products is not, at least in a limited way, affected by the presence of the insert because the insert is hidden between the plies. Therefore, embodiments of the invention enable offering absorbent sheet products of the same quality until the last sheet of the rolls to the consumers.

The rewinding unit 5 includes a perforating module 20, a cutting module 21, a winding module 22 and an extraction module 30. The rewinding unit 5 winds the web of absorbent substrate 11 into multiple logs 31.

The perforating module 20 is arranged to provide the web of absorbent substrate 11 with regularly spaced perforation lines substantially transversally orientated relatively to the machine direction MD (i.e. the perforation lines are substantially orientated according to the cross-machine direction CD).

The cutting module 21 is arranged to sever the web of absorbent substrate 11 substantially transversally relatively to the machine direction (i.e. the separation line is substantially orientated according to the cross-machine direction CD). The severing of web occurs at a transition phase, namely when a first log is finished at the end of a log production cycle, and before a second subsequent log starts to be wound at the beginning of a new log production cycle.

The winding module 22 is arranged to wind the web of absorbent substrate 11 so as to produce logs 31 of web of absorbent substrate. For example, the winding module 22 is of the peripheral or the surface type. The winding module 22 includes a rolling surface 23, a first winding roller 24, a second winding roller 25, a third winding roller 26 and a core supplier 27. The log 31 is formed by winding the web of absorbent substrate 11 onto a temporary core 41 that maintains a well defined axial hollow passageway 42. Temporary cores 41 are sequentially provided by the core supplier 27 through the rolling surface 23 before the beginning of a new log production cycle. As examples, the temporary core can be made in cardboard or plastic. The log 31 is maintained in position during the winding by the first, second and third winding rollers 24, 25, 26 rotating in surface contact with the log 31. One of the winding rollers 24, 25, 26 imposes the rotation movement of the log 31.

The extraction module 30 is arranged to extract the temporary cores 41 from the log 31 after the winding of a log is completed. The temporary core 41 may be recycled after extraction towards the core supplier 27.

The hereinbefore described winding module of the peripheral or the surface type is only an example. Embodiments of the invention are also applicable to other kinds of winding module, for example winding module using a spindle (not shown).

The produced log 31 is then cut by multiple log saws 32 of the log cutting unit 6 into multiple and individual coreless rolls 40 of absorbent sheet products.

Thereafter, the individual coreless rolls 40 are packaged and prepared for shipping (not shown).

A control module 50 is coupled to the perforating module 20, to the cutting module 21 and to the insertion unit 15 by means of an interface 51. The control module 50 controls the operation of the perforating module 20 and the cutting module 21. In particular, the control module 50 activates the cutting module 21 to sever the web of absorbent substrate 11 at a transition phase between two consecutive logs. The control module 50 further controls the operation of the perforating module 20 out of transition phases. The control module 50 further controls the operation of the insertion module 15, namely the appropriate positioning of the stiffening insert 16 with respect to the cutting line 29.

Figure 2:
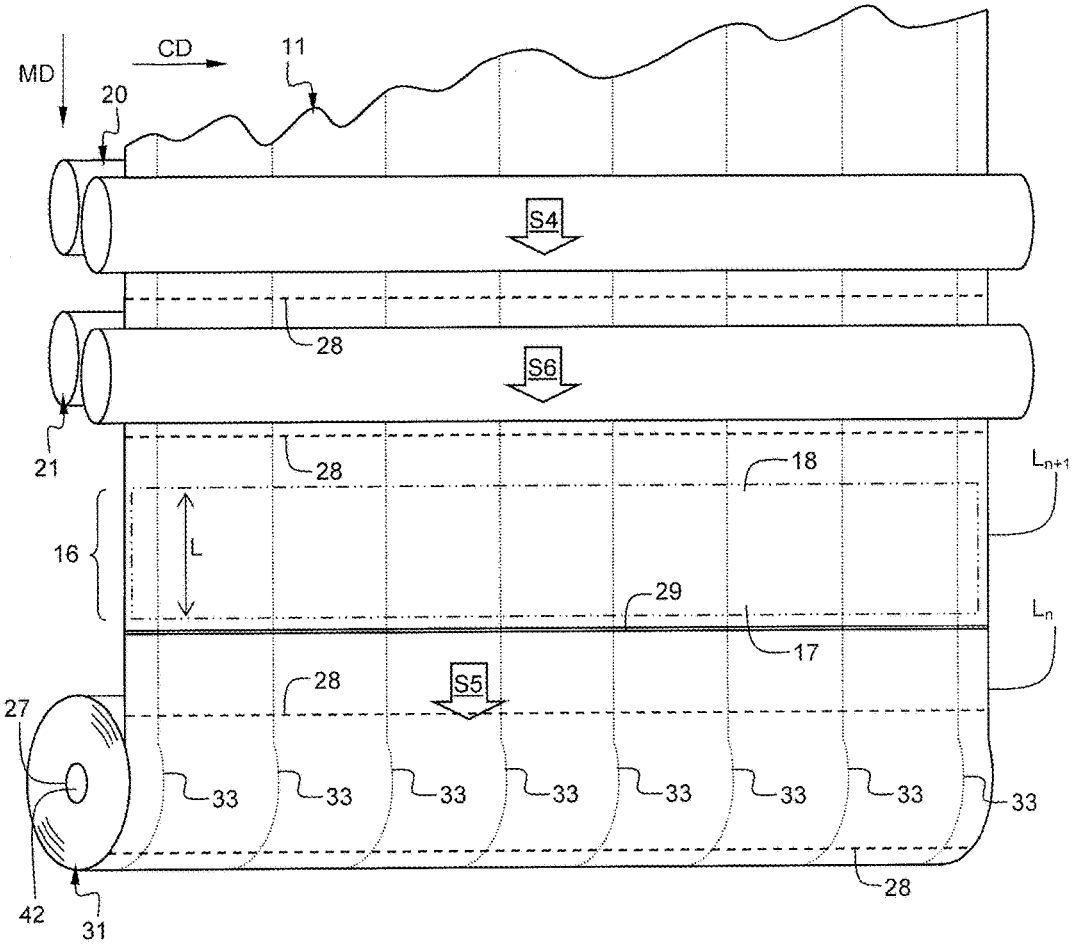
FIGS. 2 and 3 are a partial perspective view of a rewinding unit of the converting machine/line and a partial lateral cross-section view of a 3 ply web of absorbent material schematically illustrating a first position of the stiffening insert with respect to the cutting line at the transition between two logs, respectively.
Figure 4:
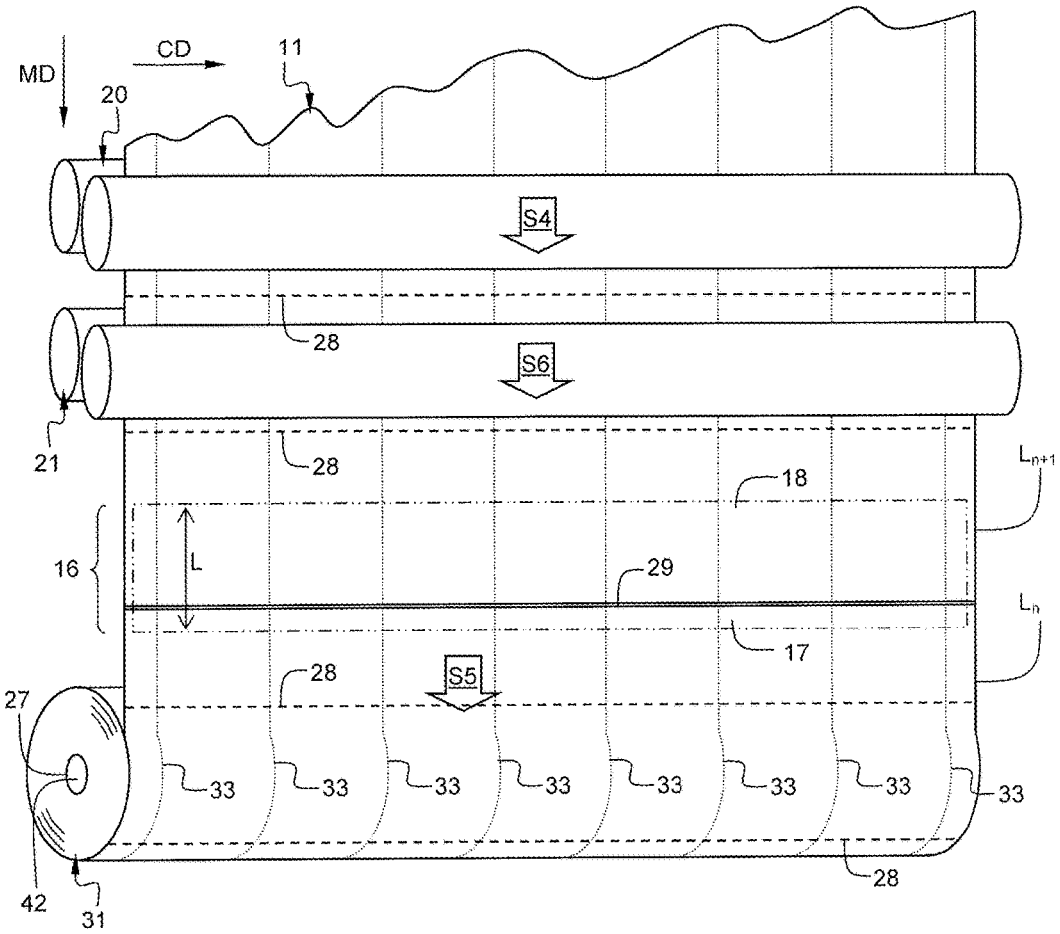
FIGS. 4 and 5 are a partial perspective view of a rewinding unit of the converting machine/line and a partial lateral cross-section view of a 3 ply web of absorbent material schematically illustrating a second position of the stiffening insert with respect to the cutting line at the transition between two logs, respectively.

FIGS. 2 and 4 are partial perspective views schematically illustrating the position of the stiffening insert 16 with respect to a cutting line 29 into a web of absorbent substrate 11 at the transition between two logs $L_n$ and $L_{n+1}$, for two different positioning of the stiffening insert 16.

The web of absorbent substrate 11 is fed into a space of the perforating module 20 including a perforator roll and a stationary anvil roll. There, the web of absorbent substrate 11 is pinched (step S4) with the desired perforation or tear lines 28 (schematically represented by dashed lines).

A perforation line 28 is a line according to a cross-machine direction CD made in the thickness of the web of absorbent substrate 11 and including alternating perforated segments and unperforated segments (i.e. two perforated segments being separated by one unperforated segment or vice-versa). Each unperforated segment forms an attachment area between two consecutive portions (according to the machine direction MD) of the web of absorbent substrate 11. Each perforated segment forms a detachment area between two consecutive portions (according to the machine direction MD) of the web of absorbent substrate 11. Considering the width of the individual roll, for example between 10 cm and 30 cm, said unperforated/perforated segments ranges, for example, between 4 mm and 10 mm. The hereinbefore described perforation line is a non limitative example, as other kinds of perforation line are possible.

Two consecutive perforation lines 28 define the individual sheet length in the individual rolls 40 of absorbent material sheet. For example, a sheet of bathroom tissue rolls may have a length of around a few dozen centimeters. In FIGS. 2 and 4, multiple phantom lines 33 parallel to the machine direction MD are also represented on the web of absorbent substrate 11 for the sole purpose of illustration. The phantom lines 33 are spaced apart in the cross-machine direction CD. They schematically represent imaginary lines where the web of absorbent substrate 11 will be cut into multiple and individual rolls 40. Thus, two adjacent phantom lines define the future edges of an individual roll. The distance between two consecutive phantom lines is equal to the full width of the individual rolls 40.

After the pinching step, the web of absorbent substrate 11 is wound (step S5) onto the core 41 in order to form a log 31 by means of the winding module 22.

Once the desired log diameter (corresponding to a substantially defined number of individual sheets wound in the log) is reached, the web of absorbent substrate 11 is cut or severed. The produced log 31 is separated (step S6) from the web of absorbent substrate 11 and subsequently a new log begins to be produced. The web of absorbent substrate 11 is fed into a space of the cutting module 21 including a cutting roll and a stationary anvil roll. There, the web of absorbent substrate 11 is severed by a cutting line 29 (schematically represented by two parallel continuous lines).

The stiffening insert 16 is positioned such as to line the axial hollow passageway 42 of the coreless roll 40, the stiffening insert having a length L such that the stiffening insert 16 extends substantially completely around a circumference of the passageway 42.

The stiffening insert 16 is positioned close to the cutting line 29 at the beginning of the log (i.e. defining the turns of the log/roll close to the hollow passageway 42), while it may be positioned upstream the cutting line 29, or between two consecutive logs $L_n$ and $L_{n+1}$ so as to straddle two consecutive logs over the cutting line 29.

FIGS. 2-5 illustrate a stiffening insert according to a first embodiment wherein the stiffening insert 16 has a width that is equal to a width of the web of absorbent substrate.

Figure 3:
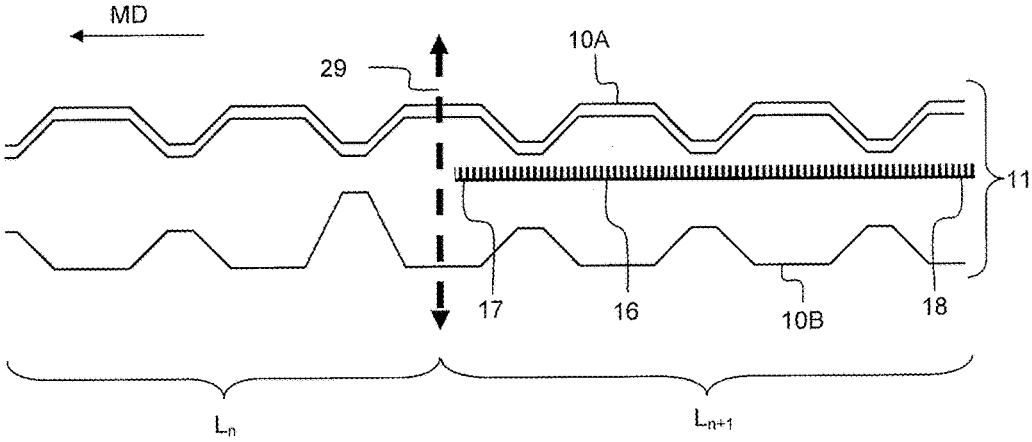

FIGS. 2 and 3 illustrate a first position of the stiffening insert 16 relatively to the cutting line 29 between two consecutive logs $L_n$ and $L_{n+1}$ wherein a leading end 17 of the stiffening insert 16 according to a length direction and a trailing end 18 of the stiffening insert 16 fully forms part of a single log. In other word, the stiffening insert is positioned upstream in the subsequent log $L_{n+1}$ but closed to the cut in the web material between two consecutive logs $L_n/L_{n+1}$. Thus, each stiffening insert 16 forms a lining portion of the axial hollow passageway of each log/roll.

Figure 5:
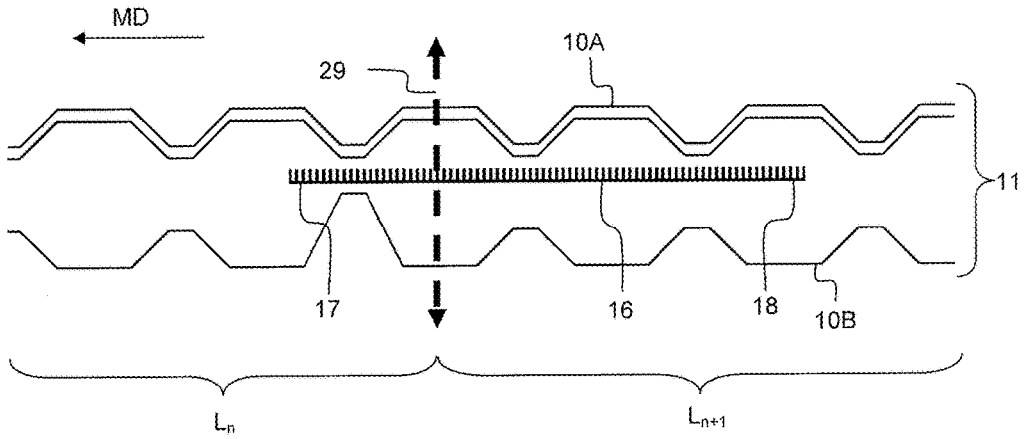

FIGS. 4 and 5 illustrate a second position of the stiffening insert 16 relatively to the cutting line 29 between two consecutive logs $L_n$ and $L_{n+1}$ wherein a leading end 17 of the stiffening insert 16 according to a length direction forms a gripping portion of a first log N and a trailing end 18 of the stiffening insert 16 forms a lining portion of the axial hollow passageway of a subsequent second log N+1. In other word, the downstream part of the stiffening insert forms a gripping portion of the log $L_n$ (i.e. the first sheet from the roll to be grasped by a consumer), while the upstream part of the stiffening insert forms a core portion of the subsequent log $L_{n+1}$. Thus, each stiffening insert 16 spans over two consecutive logs.

Figure 6:
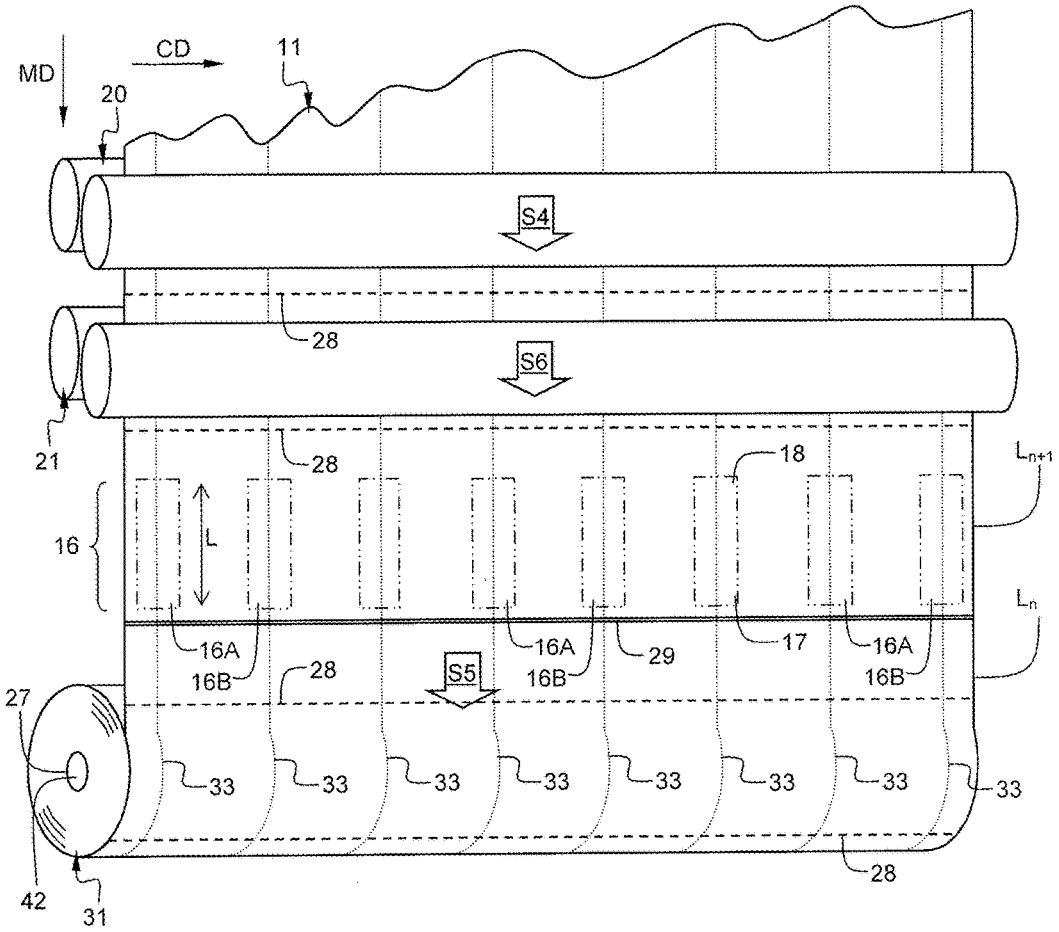
FIG. 6 is a partial perspective view of a rewinding unit of the converting machine/line schematically illustrating another stiffening insert embodiment.

FIG. 6 is a partial perspective view of a rewinding unit of the converting machine/line schematically illustrating a stiffening insert 16 according to another embodiment. In this alternative embodiment, the stiffening insert 16 includes a plurality of stripes 16A, 16B distributed along the width of the web (i.e. along the cross-direction CD). The distribution is such that a stripe is positioned straddling each phantom line 33 parallel to the machine direction MD schematically representing imaginary lines where the web of absorbent substrate 11 will be cut into multiple and individual rolls 40. Therefore, after the cutting operation, each individual roll 40 includes two stripes at the edge of the passageway 42 forming ring-like stiffening insert 16A and 16B. The total width of the stripes is inferior to the width of the web of absorbent substrate, for example the total width may represent 10% of the width of the web. The stripes can be positioned according to the first position depicted in FIGS. 2 and 3, or the second position depicted in FIGS. 4 and 5. Only the first position is represented in FIG. 6. This embodiment enables reducing the quantity of stiffening insert used, and enables offering to the end consumer a constant quality of the sheet products from the first sheet to the last sheet (at least in the central usable portion of the sheet products).

Figure 7:
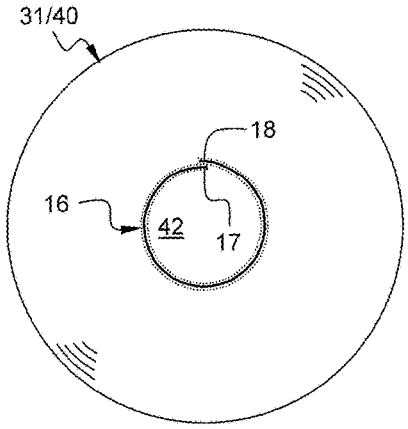
FIGS. 7 and 8 are lateral cross-section views in a log/roll showing different lengths of stiffening insert.
Figure 8:
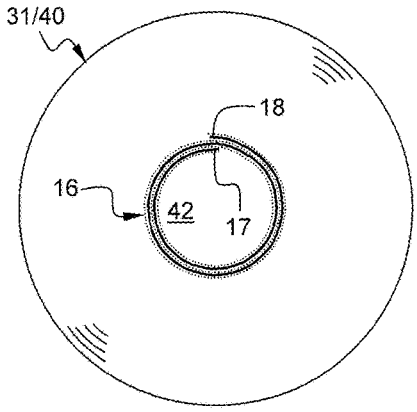

FIGS. 7 and 8 are lateral cross-section views in a log 31 or roll 40 showing different lengths of stiffening insert. FIG. 7 shows a stiffening insert 16 embodiment wherein the position and length are arranged such that the leading end 17 and the trailing end 18 according to a length direction (i.e. machine direction MD) of the stiffening insert 16 overlap each other. FIG. 8 shows a stiffening insert 16 embodiment wherein the position and length are arranged such that the leading end 17 and the trailing end 18 according to the length direction (i.e. machine direction MD) of the stiffening insert 16 overlap each other over a defined number of turns (the example illustrates two turns) so as to form a spirally conformed stiffening portion. The number of turns may be adapted to the desired resistance to be achieved, for example three, four, etc. . . . However, limiting the number of turns affected by the stiffening insert is desirable from the consumer perspective because it enables offering a constant quality of the sheet products from the first sheet to the last sheet.

Whatever the position of the stiffening insert, a loose end forming a tail of the web of absorbent substrate 11 of the produced log 31 is adhered to the log in a known manner.

The temporary core/spindle is extracted. The produced log 31 is then cut parallel to the machine direction MD by multiple log saws 32 into multiple individual rolls 40.

Obviously, the individual rolls 40 have the same characteristics with respect to the stiffening insert 16 as the logs 31.

The 2-ply toilet paper rolls currently marketed, for example Lotus Confort toilet paper roll, having a cardboard core, have a resistance to compression in the range of 300-370 N.

TABLE

| | Insert | | | Roll | | |
|---|---|---|---|---|---|---|
| | Insert Type | Basis weight ($g/m^2$) | Length (mm) | Resistance to compression RCT (N) | Roll Weight (g) | Ratio RCT/Weight (N/g) |
| Roll without stiffening insert | N/A | 0 | 0 | 201 | 104 | 1.93 |
| Roll with stiffening insert treated with a polymer | Treated Tissue | 92 (Tissue) + 0.5 (Polymer) | 420 | 261 | 108 | 2.42 |
| Roll with stiffening insert | Paper | 80 | 250 | 256 | 106 | 2.42 |

The coreless rolls of the Table have been manufactured from the same tissue paper web and have identical dimensional characteristics, namely a diameter of around 102 mm, a width of around 98 mm, a central hole (hollow passageway) diameter of around 38 mm and a roll web length of around 29.3 m.

The measurement of the resistance to compression (RCT), is determined by analogy with the measurement of the compression strength of a sample of cardboard core with a dynamometer operating at a constant speed. A sample of a given size is compressed at a constant speed, using a dynamometer which measures and records the compression force versus displacement. The measurement equipment includes a dynamometer with 1 kN cell coupled to two parallel metal plates, the dynamometer operating at a compression speed around 60 mm/min. The roll samples are 300 mm long for rolls diameter longer than 300 mm, and 100 mm long for rolls diameter below 300 mm. The resistance to compression that is measured is the flat compression, namely with the axial hollow passageway longitudinal axis parallel to the plates. The roll is positioned between the plates. The interval between the two plates is adjusted so as to be in contact with the roll. The test starts and the force in Newton (N) at distances of compressions (displacements) of 20 mm and 50 mm is measured and noted (for roll of diameter above 60 mm). Five measurements are performed and the mean value and standard deviation is calculated. The results are expressed in Newton (N).

The Table illustrates a gain of around 25% of resistance to compression (RCT) for a roll including a stiffening insert of an embodiment of the invention. This is advantageous with respect to the logistic compliance and regarding the transport (palletization) of the packaged coreless rolls.

The stiffening insert may have a defined flexibility such as to resume a shape of the axial hollow passageway to a substantially cylindrical shape after the coreless roll has been submitted to a compression transversally relatively to the axial hollow passageway.

The drawings and their descriptions hereinbefore illustrate rather than limit the invention.

Though the drawings show a particular horizontal positioning of the different modules/units/machines relatively to each other in the converting line, this is a mere example because the modules/units/machines can be positioned vertically or a combination of horizontal/vertical position. The relative position of the perforating module and the cutting module can be inversed. The converting line may also include additional modules/units/machines for performing specific converting steps not described herein. Also, the conversion of two plies is only an example as the invention would be applicable to end products including more than two plies, for example three, four, five, etc. . . .

The application of the absorbent product is broad in the domain of sanitary or domestic applications, e.g. napkins, towels, kitchen towels, hand towels, toilet papers, wipes, facial tissues, bath tissues etc. . . .

Any reference sign in a claim should not be construed as limiting the claim. The word "comprising" does not exclude the presence of other elements than those listed in a claim. The word "a" or "an" or "at least one" preceding an element does not exclude the presence of a plurality of such element.

The invention claimed is:

1. A coreless roll of absorbent sheet products comprising:

a spirally wound web of absorbent substrate, the web of absorbent substrate being wound such as to define an axial hollow passageway centrally positioned relatively to the coreless roll and extending from one edge to another edge of the coreless roll, and the web of absorbent substrate comprising at least two superposed plies; and a stiffening insert being inserted in-between two of the at least two superposed plies, and being positioned such as to line the axial hollow passageway, and having a length such that the stiffening insert extends at least around three quarter of a circumference of the passageway.

2. The coreless roll of claim 1, wherein the length of the stiffening insert is such that the stiffening insert extends substantially completely around a circumference of the passageway.

3. The coreless roll of claim 2, wherein the stiffening insert is arranged such that a leading end and a trailing end according to a length direction of the stiffening insert overlap each other.

4. The coreless roll of claim 3, wherein the stiffening insert is arranged such that the leading end and the trailing end according to the length direction of the stiffening insert overlap each other over a defined number of turns so as to form a spirally conformed stiffening portion.

5. The coreless roll according to claim 1, wherein the stiffening insert has a basis weight ranging between 20 and 140 $g/m^2$.

6. The coreless roll according to claim 1, wherein the stiffening insert has a width that is equal to a width of the web of absorbent substrate.

7. The coreless roll according to claim 1, wherein the stiffening insert comprises at least two strips distributed along the width of the web of absorbent substrate so as to form rings at edges of the coreless roll, a total width of the strips being inferior to the width of the web of absorbent substrate.

8. The coreless roll according to claim 1, wherein the stiffening insert is bonded to at least one of the at least two superposed plies.

9. The coreless roll according to claim 1, wherein the stiffening insert is made of a material selected from the group consisting of tissue paper material, non woven material, tissue paper material treated with a binding agent, non woven material treated with a binding agent, cardboard, kraft paper, and synthetic polymer.

10. A method comprising winding absorbent sheet products around the coreless roll according to claim 1, wherein the absorbent sheet products are selected from the group consisting of napkins, towels, kitchen towels, hand towels, toilet papers, wipes, and facial tissues.

* * * * *